United States Patent [19]

Kelley

[11] Patent Number: 4,968,280

[45] Date of Patent: Nov. 6, 1990

[54] ANIMATED FIGURE WITH INTERACTIVE HEAD AND TORSO

[75] Inventor: William J. Kelley, Torrance, Calif.

[73] Assignee: Mattel, Inc., Hawthorne, Calif.

[21] Appl. No.: 414,867

[22] Filed: Sep. 29, 1989

[51] Int. Cl.[5] ..... A63H 3/20; A63H 3/36; A63H 11/00

[52] U.S. Cl. ..... 446/330; 446/338; 446/340; 446/352

[58] Field of Search ..... 446/330, 338, 340, 339, 446/337, 352, 353, 354, 359, 361, 365, 370, 371, 372, 377; 40/416

[56] References Cited

U.S. PATENT DOCUMENTS

| | | | |
|---|---|---|---|
| 820,843 | 5/1906 | Arnold | 446/193 |
| 1,685,358 | 9/1928 | Harcourt | 40/416 |
| 2,137,371 | 11/1938 | Marsh | 446/330 |
| 2,764,841 | 10/1956 | Birnbaum | 446/365 |
| 3,029,552 | 4/1962 | Katz | 446/353 |
| 3,147,566 | 9/1964 | Ong | 446/359 |
| 3,475,853 | 11/1969 | Adler | 446/330 |
| 3,611,626 | 10/1971 | Bornn | 446/377 |
| 3,648,405 | 3/1972 | Tepper | 446/330 |
| 3,672,097 | 6/1972 | Gardel et al. | 446/352 |
| 3,706,155 | 12/1972 | Balza | 446/384 |
| 3,722,136 | 3/1973 | Thorn et al. | 446/354 |
| 3,858,353 | 1/1975 | Glass et al. | 446/354 |
| 3,964,205 | 6/1976 | Kuramochi | 446/338 |
| 4,217,726 | 8/1980 | Flicker et al. | 446/330 X |
| 4,560,362 | 12/1985 | Renger | 446/340 |
| 4,601,672 | 7/1986 | Cook et al. | 446/330 |
| 4,623,318 | 11/1986 | Tsiknopoulos et al. | 446/330 |
| 4,723,932 | 2/1988 | Kelley et al. | 446/330 |
| 4,828,530 | 5/1989 | Lee | 446/330 X |

*Primary Examiner*—Robert A. Hafer
*Assistant Examiner*—D. Neal Muir
*Attorney, Agent, or Firm*—Roy A. Ekstrand

[57] ABSTRACT

An animated toy figure includes an upper and lower torso pivotally joined near the figure's waist portion. A head is pivotally secured to the neck portion of the upper torso. Arm and leg members are pivotally secured to the upper and lower torso portions respectively. A gear drive and drive shaft mechanism is supported within the upper torso and is coupled between the lower torso and the head to provide rotation of the head in response to rotation of the lower torso.

13 Claims, 2 Drawing Sheets

ANIMATED FIGURE WITH INTERACTIVE HEAD AND TORSO

FIELD OF THE INVENTION

This invention relates generally to animated doll figures and particularly to those utilizing interactive body and limb combinations.

BACKGROUND OF THE INVENTION

In attempting to increase the interest and play value of animated dolls and toys figures, practitioners in the art have utilized various devices to provide the appearance of animation in such dolls and figures. One such approach has been to interactively couple various combinations of torso and limb components to provide the appearance of self or auto motion in the toy figure when manipulated by the user.

U.S. Pat. No. 4,560,362 issued to Renger sets forth an ANIMATED FIGURE TOY HAVING A MOVABLE TORSO AND ARTICULATING JAW in which a animated toy figure includes an upper torso and lower torso rotatably secured together. The upper torso supports a hollow head which is also rotatably mounted. The hollow head in turn supports a movable jaw and articulating means are coupled between the torso and articulated jaw to provide jaw movement in response to relative motions between the upper and lower torsos.

U.S. Pat. No. 4,217,726 issued to Flicker, et al. sets forth a DOLL WITH MOVABLE LEGS, HEAD, TILTABLE TORSO in which a doll is supported by a pair of legs one of which is pivotally secured to the doll torso while the other is hingedly coupled to the torso for pivotal movement about a fore-to-aft axis. The head member is interconnected through gear devices to the first leg such that relative displacement between the first and second leg members results in tilting of the torso and rotating of the doll head.

U.S. Pat. No. 8,611,626 issued to Bornn sets forth an ANIMATED DOLL including a doll's body, a head movably mounted on the body for side to side nodding motion and leg members mounted on the body for hand assisted walking motion. The legs are operatively connected to transmission mechanism which provides a side to side nodding motion of the head in response to articulation of the leg members in a walking motion.

U.S. Pat. No. 3,475,858 issued to Adler sets forth a DOLL HEAD MOVABLE AS A RESULT OF MOVEMENT OF ANOTHER DOLL BODY PART in which a doll head is mounted upon a conventional doll body and a drive mechanism is connected between the doll head and a selected pair of limb members of the doll body. The drive mechanism and connected limbs interact to cause rotation of the doll head in response to arm motion.

U.S. Pat. No. 3,648,405 issued to Tepper sets forth a DOLL TWISTABLE AT THE WAIST in which a doll includes upper and lower torso portions pivotally interconnected at the waist. The doll head and arm are pivotally mounted on the upper torso and transmission means interconnect the head, arm and lower torso portion to transmit swinging movement of the arm to head and lower torso portions of the doll.

U.S. Pat. No. 2,137,371 issued to Marsh sets forth a DOLL in which a body portion supports a pivotally secured head portion and a plurality of limbs. The head portion and one of the doll's limbs are interconnected by articulating means which permit the head to nod or move through an arc in response to arm motion.

U.S. Pat. No. 3,706,155 issued to Balza sets forth a JOINTED FIGURE HAVING COOPERATING BEARING SURFACES OF DUPLICATE SIZE AND CONTOURS in which a toy figure includes a torso having the same appearance when viewed from either the front or rear. Means are provided for rotatably connecting the torso to the trunk portion of the doll along a forty-five degree planar surface. The toy figure or doll is thus readily converted between a standing position and sitting position by rotating the torso one hundred eighty degrees thereby changing the angle between the trunk and the torso.

U.S. Pat. No. 820,843 issued to Arnold sets forth a DOLL in which the doll body is supported upon wheels which permit the doll to be rolled across a supporting surface. Various articulating means are coupled between the rotating support wheels and various limbs and other body portions of the doll including a sound generator to provide noise and animation as the doll is moved or rolled across the support surface.

U.S. Pat. No. 1,685,358 issued to Harcourt sets forth a MECHANICAL MANIKIN in which a manikin includes a plurality of articulated body and limb portions supported by a fixed leg member and a supporting base. Various operating means are provided to cause the limb and body portions of the manikin to undergo predetermined motion patterns corresponding to the desired poses used in manikin displays.

U.S. Pat. No. 8,964,205 issued to Kuramochi sets forth a FIGURE WITH MOVABLE TRUNK, HEAD, ETC HAVING DRIVING DEVICE AND INDIVIDUAL OPERATION MEANS in which a motion toy is adapted to undergo various animation patterns such as clapping of hands, movement of eyes, movements of ears, and head shaking as well as lip motion and voice-like sound emission in response to an electrically powered motor within the toy figure.

U.S. Pat. No. 3,147,566 issued to Liu Hong Ong sets forth a MECHANICAL DOLL in which a movable head and movable arms are supported upon a doll torso. Mechanical means are provided within the doll torso and are driven by a central thumb wheel drive mechanism to provide motion of the doll head and arm members in response to the manipulation of the thumb wheel.

U.S. Pat. No. 4,628,318 issued to Tsiknopoulos, et al. sets forth a FIGURE WITH ROTATABLE TORSO AND VERTICALLY SWINGING ARMS in which an animated toy figure includes an upper and lower torso pivotally secured at or near the figure's waist. A pair of limb members are pivotally secured to the upper torso so as to permit vertical motion of the arm members in response to rotation of the upper torso. Thumb wheel drive means are supported within the lower torso and are operatively coupled to the upper torso to permit rapid rotational motion of the upper torso relative to the lower torso in response to thumb wheel motion. During upper torso rotation, centrifugal force is operative upon the arm members to cause them to rise vertically.

While the foregoing described articulated and interactive motion doll and toy figures have to date provided considerable animation and enhanced play value, there remains a need in the art for still further combinations of articulation and play motion in toy and doll figures.

SUMMARY OF THE INVENTION

Accordingly, it is a general object of the present invention to provide an improved animated doll or toy figure. It is a more particular object of the present invention to provide an improved animated doll or toy figure in which the appearance of realistic head motion is provided.

In accordance with the present invention, there is provided an animated toy figure having a hollow upper torso portion pivotally secured to a lower torso portion. A drive gear is supported within the upper torso portion and is fixed to the lower torso portion. A head member is pivotally supported by the upper torso portion and a drive shaft is coupled between the drive gear and the head member to provide opposite direction motion of the head in response to pivotal motion of the upper torso with respect to the lower torso.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
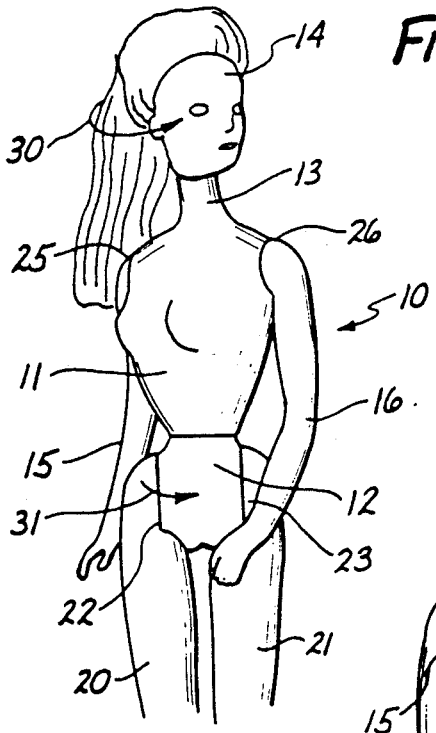
FIG. 1 is a perspective view of an animated toy figure constructed in accordance with the present invention

FIG. 1 sets forth a perspective view of an animated toy figure constructed in accordance with the present invention and generally referenced by numeral 10. FIG. 10 includes an upper torso 11 and a lower torso 12. Upper torso 11 and lower torso 12 are joined in a pivotal attachment by means set forth below in greater detail at joint 24. Upper torso 11 further defines an upwardly extending neck portion 13. A head member 14 is, in accordance with the invention set forth below in greater detail, pivotally secured to neck 13. A right arm 15 and a left arm 16 are joined to upper torso 11 at a right shoulder joint 25 and a left shoulder joint 26 respectively. A right leg 20 and a left leg 21 are pivotally joined to lower torso 12 at a right leg joint 22 and a left leg joint 28 respectively.

In accordance with the invention and by means set forth below greater detail, rotation of upper torso 11 with respect to lower torso 12 in the direction indicated by arrow 31 produces a corresponding opposite direction rotation of head 14 in the direction indicated by arrow 30. It will be apparent from the descriptions and discussions set forth below that rotation of upper torso 11 with respect to lower torso 12 in the opposite direction of arrow 31 produces a corresponding rotation of head 14 in the opposite direction to arrow 30. Thus, in accordance with the invention with lower torso 12 maintained in a stationary position, the rotation of upper torso 11 in one direction produces an opposite direction rotation of head 14.

Figure 2:
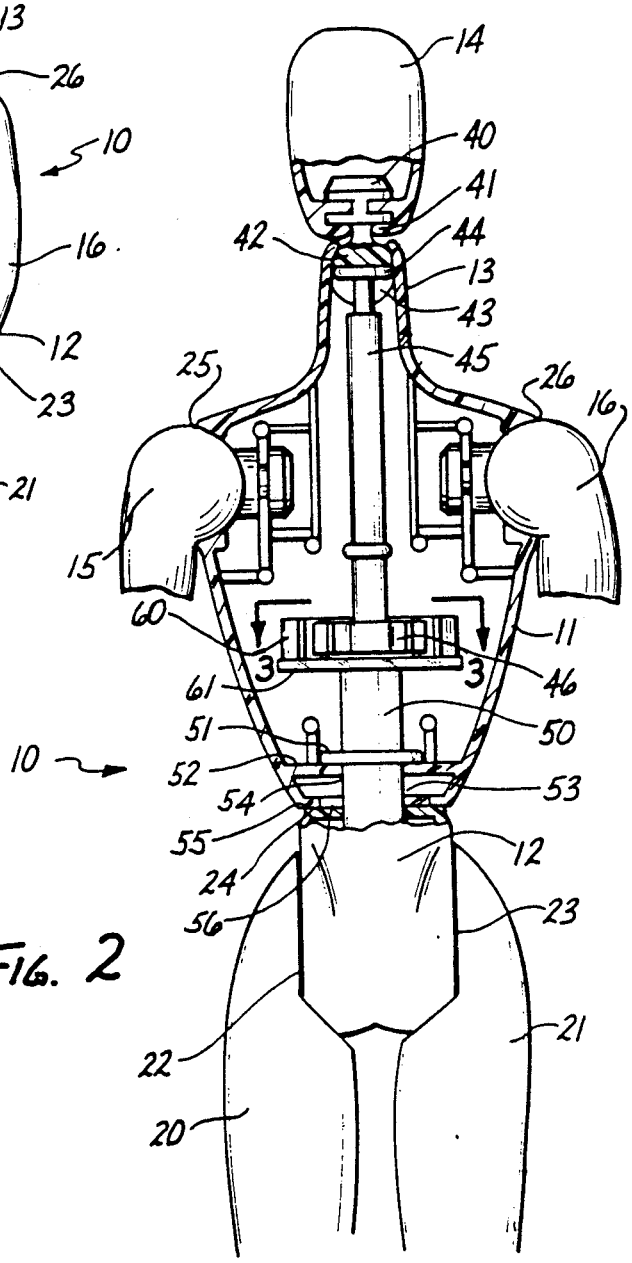
FIG. 2 is a partially sectioned view of the present invention toy figure taken along section lines 2—2 in FIG. 3.
Figure 3:
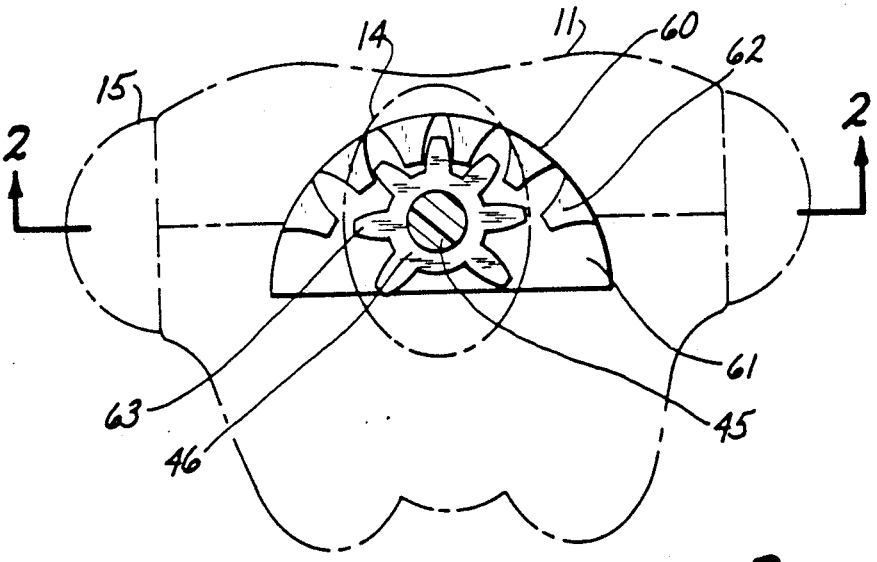
FIG. 3 is a section view of the present invention toy figure taken along section lines 3—3 in FIG. 2.

FIG. 2 sets forth a partially sectioned view of toy figure 10 taken along section lines 2—2 in FIG. 3. FIG. 10 includes an upper torso 11, a head 14, a right arm 15, a left arm 16, a lower torso 12, a right leg 20 and a left leg 21. Right leg 20 and left leg 21 are secured to lower torso 12 by leg joints 22 and 28 respectively. Right arm 15 and left arm 16 are secured to upper torso 11 by shoulder joints 25 and 26 respectively. Head 14 includes a head support 40 forming a secure attachment thereto and providing stability for head 14.

Torso 11 defines an upwardly extending hollow neck member 13 terminating in a neck aperture 41. Head 14 further defines a downwardly extending coupling member 42 extending through neck aperture 41 and terminating in a downwardly facing slot 43. Torso 11 further defines an interior web 52 extending inwardly and terminating in an aperture 54. Torso 11 further defines an aperture 53 in alignment with aperture 54 in web 52

Lower torso 12 defines an upwardly extending generally cylindrical gear pedestal 50 which extends through apertures 58 and 54 and terminates in a generally planar plate member 61. A generally cylindrical flange 51 extends outwardly from gear pedestal 50 and rests upon the upper surface of web 52 of upper torso 11. Lower torso 12 defines a generally planar upper surface 55 which rests against lower surface 56 of upper torso 11 and provides the bearing surface for joint 24. The combination of lower surface 56 and flange 51 captivate gear pedestal 50 within apertures 53 and 54 of upper torso 11 in a pivotal attachment in accordance with which upper torso 11 is pivotal with respect to the combination of lower torso 12 and gear pedestal 50.

Gear pedestal 50 further supports a drive gear portion 60 which as is better shown in FIG. 8 defines a plurality of inwardly extending gear teeth. In accordance with an important aspect of the present invention, drive gear 60, plate 61, gear pedestal 50 and lower torso 12 are rigidly formed of a common unit.

A drive shaft 45 defines an elongated cylindrical member having an upper end terminating in a horizontally positioned generally cylindrical snap bar 44 and a lower end terminating in a driven gear 46. As is better seen in FIG. 3, driven gear 46 defines a plurality of outwardly extending gear teeth configured to engage and be driven by the corresponding gear teeth of drive gear 60. Driven gear 46 rests upon plate 61 and is pivotal with respect thereto. Snap bar 44 is received within slot 43 of coupling 42 in a snap-fit engagement which securely attaches drive shaft 45 to coupling 42 such that head 14 is rotatable by rotation of drive shaft 45.

In operation, the rotation of lower torso 12 with respect to upper torso 11 causes a corresponding rotation of gear pedestal 50 and drive gear 60. The rotation of drive gear 60 with respect to upper torso 11 causes a rotation of drive shaft 45 due to the engagement of driven gear 46 and drive gear 60. The relative angular rotation of drive shaft 45 produced by the rotation of drive gear 60 is determined by the gear ratio between drive gear 60 and driven gear 46. In the preferred embodiment, a two to one gear ratio is provided between drive gear 60 and driven gear 46 such that rotation of lower torso 12 and thereby drive gear 60 through a forty-five degree angle produces a corresponding ninety degree angular rotation of drive shaft 45.

As previously mentioned, drive shaft 45 is securely coupled to head 14 by the combination of snap bar 44 and coupling 42 such that head 14 is rotated in direct correspondence to rotation of drive shaft 45. Thus, the above-described rotation of lower torso 12 through a forty-five degree angle produces a corresponding ninety degree rotation of drive shaft 45 and head 14. Thus in accordance with an important aspect of the present invention, the rotation of lower torso 12 with respect to upper torso 11 produces a corresponding rotational motion of head 14 with respect to upper torso 11.

Figure 4:
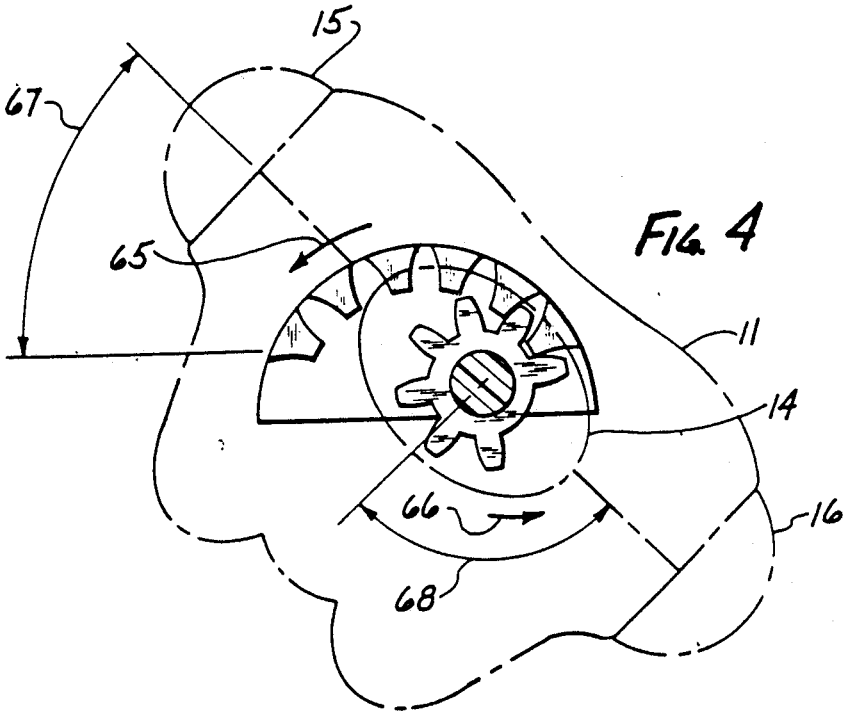
FIG. 4 is a section view of the present invention toy figure taken along section lines 3—3 in FIG. 2 showing the upper torso rotated with respect to the lower torso.

FIGS. 3 and 4 set forth partially sectioned views of the present invention toy figure taken along section lines 3—3 in FIG. 2. For purposes of illustration, upper torso 11 and right arm 15 and left arm 16 are shown in dashed line representation to permit the illustration of the present invention head turning articulation. Drive gear 60 and plate 61 are shown extending upwardly into the interior cavity of upper torso 11. Correspondingly, drive gear 46 rests upon plate 61 and drive shaft 45 extends upwardly from drive gear 46. Drive gear 60 defines a plurality of gear teeth 62 extending inwardly in an evenly spaced arrangement approximating a semicircular configuration. Correspondingly, drive gear 46 defines a plurality of outwardly extending gear teeth 68 having angular spacing therebetween to permit the engagement of gear teeth 63 with gear teeth 62 such that rotation of drive gear 60 causes a corresponding gear coupling between drive gear 60 and driven gear 46.

In the position shown in FIG. 3, upper torso 11 and lower torso 12 (not seen) are in general alignment causing drive gear 60 and driven gear 46 to assume the relative angular positions shown in FIG. 8. Head 14 is shown in FIGS. 3 and 4 in dashed line representation and in the position shown in FIG. 3 is angularly positioned with respect to upper torso 11 in a forwardly facing alignment.

FIG. 4 sets forth the relative positions of operative components of the present invention animated toy figure following the rotation of lower torso 12 (seen in FIG. 2) with respect to upper torso il in the direction indicated by arrow 65. As described above, the rotation of lower torso 12 with respect to upper torso 11 causes a corresponding rotation of drive gear 60. Thus drive gear 60 is rotated with respect to upper torso 11 in the direction indicated by arrow 65. For purposes of illustration, lower torso 12 and drive gear 60 are rotated in FIG. 4 to an approximate forty-five degree angle displacement from the positions shown in FIG. 3. The rotation of drive gear 60 causes a corresponding rotation of driven gear 46 and drive shaft 45 in the direction indicated by arrow 66. The angular rotation of drive shaft 45 in turn causes a angular rotation of head 14 to the position shown in FIG. 4. As can be seen, head 14 has undergone an angular rotation 68 which is approximately twice the angular rotation 67 undergone bY drive gear 60 and lower torso 12. Thus in accordance with an important aspect of the present invention, the rotation of lower torso 12 with respect to upper torso 11 causes a corresponding rotation of approximately twice the angular displacement of head 14 with respect to upper torso 11. It will be apparent to those skilled in the art from examination of FIGS. 3 and 4 and the discussions set forth above that an opposite direction rotation of lower torso 12 with respect to upper torso 11 will produce a corresponding opposite direction rotation of head 14 which will also be angularly displaced by a two times factor. Thus in accordance with an important aspect of the present invention, rotations of lower torso 12 with respect to upper torso 11 produce corresponding rotations of head 14 with respect to upper torso 11 which are twice the angular displacement of lower torso 12.

What has been shown is an improved animated toy figure having an interactive head and torso articulation system in which the head of the toy figure can be made to appear to undergo angular rotation of substantial angular displacement in response to relatively small angular displacement of the lower torso of the figure with respect to its upper torso.

While particular embodiments of the invention have been shown and described, it will be obvious to those skilled in the art that changes and modifications may be made without departing from the invention in its broader aspects. Therefore the aim in the appended claims is to cover all such changes and modifications as fall within the true spirit and scope of the invention.

That which is claimed is:

1. An animated toy figure comprising:

an upper torso defining a neck portion and an interior body cavity;

a lower torso pivotably secured to said upper torso;

a drive gear fixedly secured to said lower torso and supported within said body cavity;

an elongated drive shaft, rotatably supported within said body cavity, and having first and second ends and a driven gear at said first end thereof engaging said drive gear and a first coupling member at said second end proximate to said neck portion of said upper torso; and a head portion having a second coupling member cooperating with said first coupling member to secure said head to said drive shaft, said lower torso, said gear pedestal, said flange and said drive gear being formed of a single molded component and said upper torso, said neck portion, said lower surface and said web being formed of two mating half portions, said drive gear, said elongated drive shaft, said first coupling member and said second coupling members cooperating to turn said head portion relative to said upper torso when said upper torso is pivoted relative to said lower torso.

2. An animated toy figure as set forth in claim 1 wherein said upper torso defines a lower surface having a first aperture therein and an inwardly extending web defining a second aperture concentric with said first aperture, and wherein said lower torso includes a generally cylindrical gear pedestal extending through said first and second apertures and supporting said drive gear within said cavity.

3. An animated toy figure as set forth in claim 2 wherein said upper torso defines a neck portion having a third aperture therein and wherein said second coupling member extends through said third aperture and is rotatably supported within said neck portion.

4. An animated toy figure as set forth in claim 3 wherein said gear pedestal defines an outwardly extending flange supporting said gear pedestal upon said web and securing said upper and lower torsos together.

5. An animated toy figure as set forth in claim 4 wherein said drive gear is generally semicylindrical.

6. An animated toy figure as set forth in claim 5 wherein said drive gear and said driven gear define an approximate two to one gear ratio therebetween such that said driven gear undergoes angular rotations twice that of said drive gear.

7. An animated toy figure as set forth in claim 1 wherein said drive gear and said driven gear define an approximate two to one gear ratio therebetween such that said driven gear undergoes angular rotations twice that of said drive gear.

8. An animated toy figure comprising:

an upper torso defining a neck portion and an interior body cavity;

a lower torso pivotably secured to said upper torso;

a drive gear fixedly secured to said lower torso and supported within said body cavity, said drive gear comprising a flat plate support for a peripheral gear segment which faces inward within said body cavity;

an elongated drive shaft, rotatably supported within said body cavity, and having first and second ends and a driven gear at said first end thereof engaging said drive gear and a first coupling member at said second end proximate to said neck portion of said upper torso; and a head portion having a second coupling member cooperating with said first coupling member to secure said head to said drive shaft, said drive gear, said elongated drive shaft, said first coupling member and said second coupling members cooperating to turn said head portion relative to said upper torso when said upper torso is pivoted relative to said lower torso.

9. An animated toy figure as set forth in claim 8 wherein said upper torso defines a lower surface having a first aperture therein and an inwardly extending web defining a second aperture concentric with said first aperture, and wherein said lower torso includes a generally cylindrical gear pedestal extending through said first and second apertures and supporting said drive gear within said cavity.

10. An animated toy figure as set forth in claim 9 wherein said upper torso defines a neck portion having a third aperture therein and wherein said second coupling member extends through said third aperture and is rotatably supported within said neck portion.

11. An animated toy figure as set forth in claim 10 wherein said gear pedestal defines an outwardly extending flange supporting said gear pedestal upon said web and securing said upper and lower torsos together.

12. An animated toy figure as set forth in claim 11 wherein said drive bear and said driven gear define an approximate two to one gear ratio therebetween such that said driven gear undergoes angular rotations twice that of said drive gear.

13. An animated toy figure as set forth in claim 12 wherein said lower torso, said gear pedestal, said flange and said drive gear are formed of a single molded component and wherein said upper torso, said neck portion, said lower surface and said web are formed of two mating half portions.

* * * * *